US009381613B2

(12) United States Patent
Leighton et al.

(10) Patent No.: US 9,381,613 B2
(45) Date of Patent: Jul. 5, 2016

(54) REINFORCEMENT RING FOR CARRIER HEAD

(71) Applicant: Applied Materials, Inc., Santa Clara, CA (US)

(72) Inventors: Jamie Stuart Leighton, Palo Alto, CA (US); Stacy Meyer, San Jose, CA (US); Young J. Paik, Campbell, CA (US)

(73) Assignee: Applied Materials, Inc., Santa Clara, CA (US)

( * ) Notice: Subject to any disclaimer, the term of this patent is extended or adjusted under 35 U.S.C. 154(b) by 156 days.

(21) Appl. No.: 14/163,914

(22) Filed: Jan. 24, 2014

(65) Prior Publication Data

US 2014/0273776 A1 Sep. 18, 2014

Related U.S. Application Data

(60) Provisional application No. 61/780,575, filed on Mar. 13, 2013.

(51) Int. Cl.
*B24B 37/30* (2012.01)
*B24B 41/06* (2012.01)

(52) U.S. Cl.
CPC ..... *B24B 37/30* (2013.01); *B24B 41/061* (2013.01)

(58) Field of Classification Search
CPC ..... B24B 37/30; B24B 41/002; B24B 41/061
See application file for complete search history.

(56) References Cited

U.S. PATENT DOCUMENTS 5,738,574 A 4/1998 Tolles et al.
6,277,014 B1 8/2001 Chen et al.
6,439,964 B1 8/2002 Prahbu et al.
6,776,694 B2 * 8/2004 Zuniga ..... F16J 3/02 451/388
7,001,257 B2 * 2/2006 Chen ..... B24B 37/30 451/288
7,101,273 B2 * 9/2006 Tseng ..... B24B 37/30 451/288
7,575,504 B2 * 8/2009 Zuniga ..... B24B 37/32 451/288
7,654,888 B2 * 2/2010 Zuniga ..... B24B 37/32 451/288
7,699,688 B2 4/2010 Zuniga et al.
7,727,055 B2 * 6/2010 Zuniga ..... B24B 37/30 428/119
7,901,273 B2 * 3/2011 Zuniga ..... B24B 37/32 451/288
7,950,985 B2 * 5/2011 Zuniga ..... B24B 37/30 428/119
8,469,776 B2 * 6/2013 Zuniga ..... B24B 37/30 428/119
8,475,231 B2 * 7/2013 Paik ..... B24B 37/30 451/288
8,840,446 B2 * 9/2014 Chen ..... B24B 41/067 451/285
2004/0005842 A1 * 1/2004 Chen ..... B24B 37/30 451/41
2005/0142995 A1 * 6/2005 Perlov ..... B24B 37/30 451/402

(Continued)

FOREIGN PATENT DOCUMENTS

KR 10-2005-0116072 12/2005
KR 10-1223010 1/2013

OTHER PUBLICATIONS

International Search Report and Written Opinion in International Application No. PCT/US2014/013033, mailed Jun. 13, 2014, 11 pages.

*Primary Examiner* — Timothy V Eley
(74) *Attorney, Agent, or Firm* — Fish & Richardson P.C.

(57) ABSTRACT

A reinforcement ring is for placement in a carrier head to abut an inner surface of a perimeter portion of a flexible membrane. The reinforcement ring includes a substantially vertical cylindrical portion, a first flange projecting inwardly from the bottom of the cylindrical portion, and a second flange projecting outwardly from a bottom of the cylindrical portion. The second flange projects downwardly at a non-zero angle from vertical.

19 Claims, 4 Drawing Sheets

(56) References Cited

U.S. PATENT DOCUMENTS

2005/0272346 A1 12/2005 Boo et al.
2011/0212672 A1 9/2011 Zuniga et al.
2012/0034848 A1* 2/2012 Chen ..... B24B 41/067 451/28
2012/0325395 A1 12/2012 Zuniga et al.
2013/0065495 A1 3/2013 Gajendra et al.
2013/0196573 A1* 8/2013 Fukushima ..... B24B 37/32 451/36
2013/0316628 A1* 11/2013 Jang ..... B24B 37/30 451/398
2014/0150974 A1* 6/2014 Oh ..... B24B 37/27 156/345.12
2014/0273756 A1* 9/2014 Chen ..... B24B 37/32 451/28

* cited by examiner

REINFORCEMENT RING FOR CARRIER HEAD

CROSS-REFERENCE TO RELATED APPLICATIONS

This application claims priority to U.S. Application Ser. No. 61/780,575, filed on Mar. 13, 2013, the entire disclosure of which is incorporated by reference.

TECHNICAL FIELD

The present disclosure relates to a carrier head for chemical mechanical polishing.

BACKGROUND

Integrated circuits are typically formed on substrates, particularly silicon wafers, by the sequential deposition of conductive, semiconductive or insulative layers. One fabrication step involves depositing a filler layer over a non-planar surface and planarizing the filler layer. For certain applications, the filler layer is planarized until the top surface of a patterned layer is exposed. A conductive filler layer, for example, can be deposited on a patterned insulative layer to fill the trenches or holes in the insulative layer. After planarization, the portions of the conductive layer remaining between the raised pattern of the insulative layer form vias, plugs, and lines that provide conductive paths between thin film circuits on the substrate. For other applications, such as oxide polishing, the filler layer is planarized until a predetermined thickness is left over the non-planar surface. In addition, planarization of the substrate surface is usually required for photolithography.

Chemical mechanical polishing (CMP) is one accepted method of planarization. This planarization method typically requires that the substrate be mounted on a carrier head. The exposed surface of the substrate is typically placed against a rotating polishing pad. The carrier head provides a controllable load on the substrate to push it against the polishing pad. A polishing liquid, such as a slurry with abrasive particles, is typically supplied to the surface of the polishing pad. For polishing of a metal layer on a substrate, e.g., a copper layer, the slurry can be acidic.

SUMMARY

In a multi-zone carrier head, pressure can be applied to an outermost zone while vacuum is drawn on an inner zone in order to chuck a substrate to the carrier head. In effect, this forms a "suction cup" which picks up the substrate. However, for flatted wafers, the flatted area can extend beyond the outermost zone, which can interfere with creation of the suction cup. An appropriately configured ring can be positioned in a chamber so that the pressure is applied to a region that entirely covers the flat.

In one aspect, a reinforcement ring is for placement in a carrier head to abut an inner surface of a perimeter portion of a flexible membrane. The reinforcement ring includes a substantially vertical cylindrical portion, a first flange projecting inwardly from the bottom of the cylindrical portion, and a second flange projecting outwardly from a bottom of the cylindrical portion. The second flange projects downwardly at a non-zero angle from vertical.

Implementations aspects may include one or more of the following features. The second flange may extend downwardly at a non-zero angle from vertical. The second flange may extend lower than the first flange. An outwardly extending lip may be positioned at the top of the cylindrical portion. The angle may be between 30° and 60°.

In another aspect, a carrier head for a chemical mechanical polishing system includes a base assembly, a retaining ring secured to the base assembly, a flexible membrane secured to the base assembly, and a reinforcement ring. The flexible membrane includes a main portion with a lower surface to provide a substrate-mounting surface, an annular outer portion extending upwardly from an outer edge of the main portion, the annular outer portion having a lower edge connected to the main portion and an upper edge, and a plurality of annular flaps connected to the base assembly to divide a volume between the main portion and the base assembly into a plurality of chambers, the plurality of annular flaps including a first annular flap joined to an inner surface of the main portion. The reinforcement ring includes a substantially vertical cylindrical portion abutting an inner surface of the annular outer portion, and a first flange projecting inwardly from the bottom of the cylindrical portion without contacting the first annular flap. The first flange projects downwardly at n non-zero angle from vertical.

Implementations may include one or more of the following features. The plurality of annular flaps may include a second annular flap joined to the annular outer portion at a position between a lower edge of the perimeter portion and an upper edge of the perimeter portion and a third annular flap joined to the upper edge of the annular outer portion. The second annular flap may extend inwardly from the outer annular portion, and the third annular flap may extend inwardly from the outer annular portion. The membrane and reinforcement ring may be configured such that when pressure is applied to both a first chamber between the first flap and the second flap and to a second chamber between the second flap and the third flap, the first flange does not contact an inner surface of a section of the main portion between the first flap and the perimeter portion. The membrane and reinforcement ring may be configured such that when vacuum is applied to the first chamber and pressure is applied to the second chamber, the first flange contacts the inner surface of the section of the main portion between the first flap and the perimeter portion. The membrane may include a recess on an inner surface of the perimeter portion and the reinforcement ring includes a second flange projecting outwardly from a bottom of the cylindrical portion into the recess. The second flange may extend downwardly at a non-zero angle from vertical. The second flange may extend lower than the first flange. The membrane may include a recess on an inner surface of the perimeter portion and the reinforcement ring includes an outwardly extending lip positioned at the top of the cylindrical portion and projecting into the recess. The angle may be between 30° and 60°. A section of the main portion between the first flap and the perimeter portion may be thinner than a section of the main portion radially inward of the first flap. The substrate mounting surface may have a diameter of about 150 mm. The first annular flap may be joined to the main portion about 10 mm from the outer edge of the main portion. The flexible membrane may include an annular recess in an outer surface of the perimeter portion and a second reinforcement ring positioned in the recess.

Implementations can include one or more of the following advantages. A multi-chamber carrier head can use a conventional pressure scheme—pressure on the outermost zone and vacuum on inner zone(s)—to chuck a substrate. The chucking operation can be performed more reliably, particularly for substrates with diameter of 150 mm or less.

The details of one or more implementations are set forth in the accompanying drawings and the description below. Other aspects, features, and advantages will be apparent from the description and drawings, and from the claims.

DETAILED DESCRIPTION

Figure 1A:
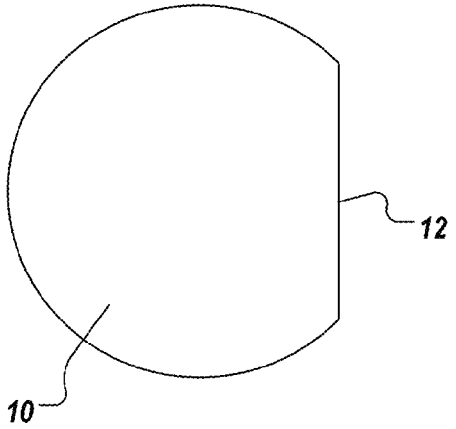
FIG. 1A is a schematic top view of a flatted wafer.

Referring to FIG. 1A, some circular substrates 10, e.g., wafers under 200 mm in diameter, e.g., 150 mm diameter wafers, include one or more wafer flats 12. The wafer flat 12 is side of the wafer that is cut into a straight line. In general, the wafer flat indicates the crystallographic planes of the wafer, which can assist the operator for proper orientation of the wafer during processing.

Figure 1B:
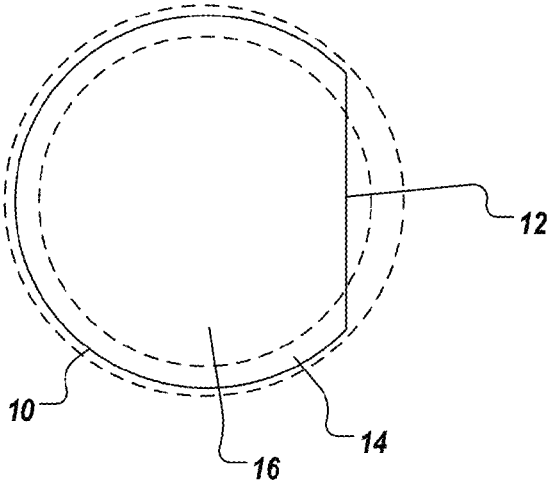
FIG. 1B is a schematic top view showing regions where vacuum and pressure are applied to a flatted wafer.

Some chemical mechanical polishing systems include a multi-zone carrier head. For example, referring to FIG. 1B, pressure can be applied to an outermost zone 14 while vacuum is drawn on an inner zone 16 in order to chuck a substrate to the carrier head. However, the outermost zone 14 can be relatively narrow in order to provide better control of the polishing rate near the wafer edge. In some carrier head configurations, the inner zone 16 can extend beyond the flat 12 of a flatted wafer 10. Without being limited to any particular theory, since the inner zone 16 extends beyond the flat 12, the inner zone 16 is not sealed, impeding creation of a vacuum behind the substrate, thus reducing reliability of the chucking operation.

An appropriately configured ring can be positioned in a chamber in the carrier head to maintain the membrane in contact with back surface of the substrate.

During a polishing operation, one or more substrates can be polished by a chemical mechanical polishing (CMP) apparatus that includes a carrier head 100. A description of a CMP apparatus can be found in U.S. Pat. No. 5,738,574.

Figure 2:
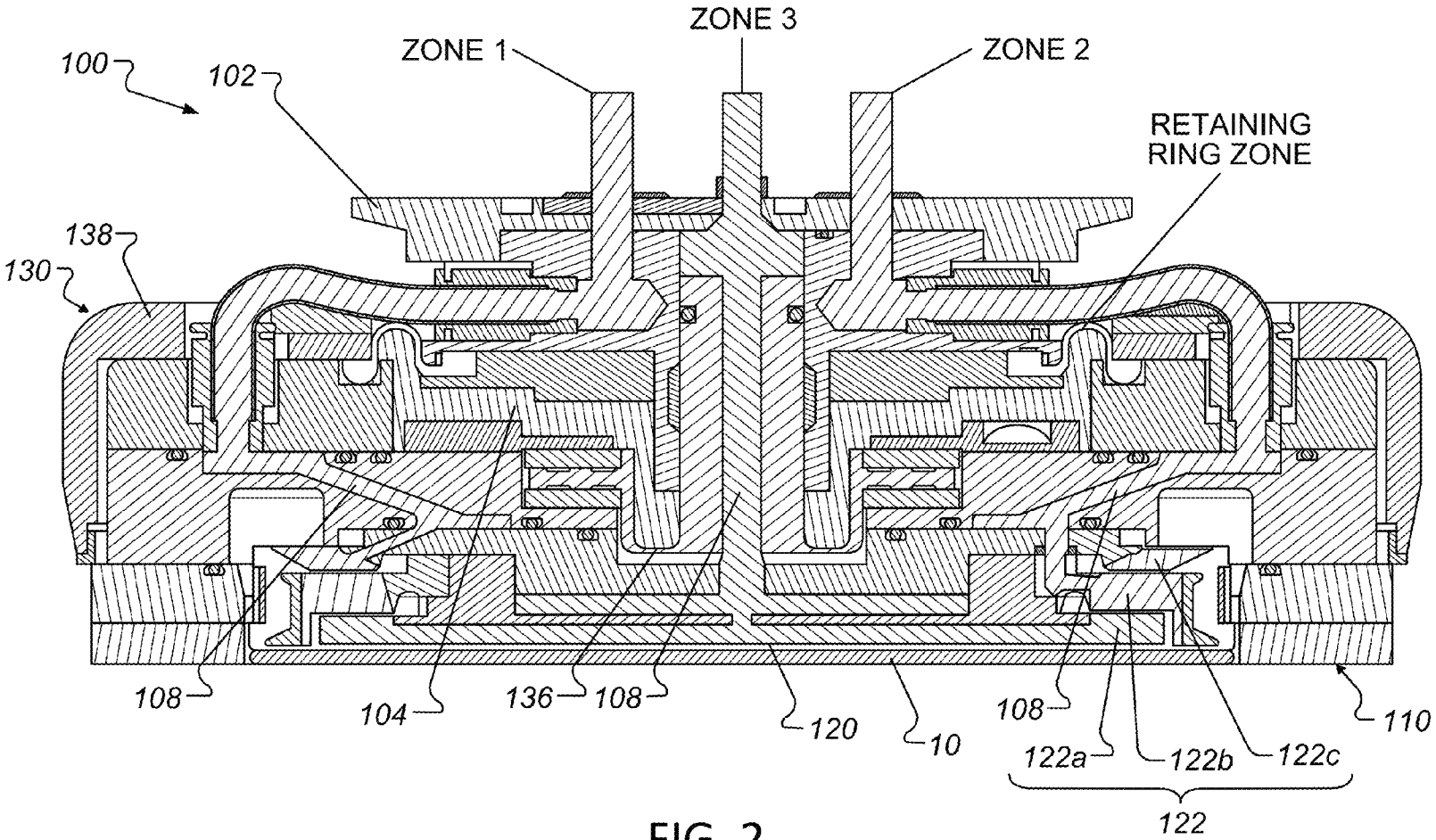
FIG. 2 is a schematic cross-sectional view of a carrier head for a chemical mechanical polishing apparatus.
Figure 3:
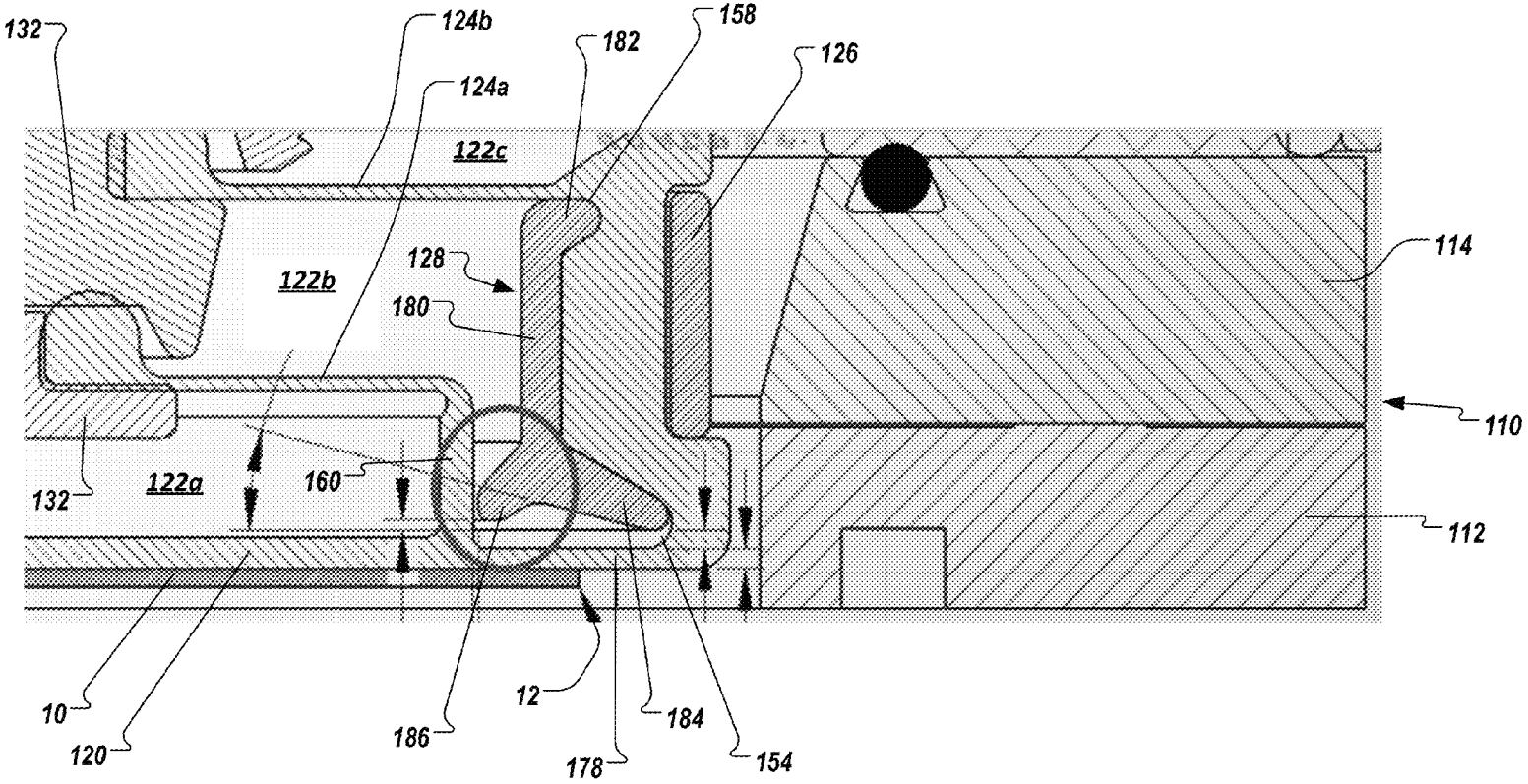
FIG. 3 is an enlarged view of the right hand side of the carrier head of FIG. 2.

Referring to FIGS. 2-3, an exemplary carrier head 100 includes a housing 102, a base assembly 130 that is vertically movable relative to the housing 102, a pressurizable chamber 104 between the housing 102 and the base assembly 130 that controls the vertical position or downward pressure on the base assembly 130, a flexible membrane 120 secured to the base assembly 130 with a bottom surface that provides a mounting surface for the substrate, a plurality of pressurizable chambers 122 between the membrane 120 and the base assembly 130, and a retaining ring 110 secured near the edge of the base assembly 130 to hold the substrate below membrane 120. The housing 102 can be secured to a drive shaft, and the drive shaft can rotate and/or translate the carrier head across a polishing pad.

The retaining ring 110 may be a generally annular ring secured at the outer edge of the base assembly 130, e.g., by screws or bolts that extend through aligned passages in the base assembly 120 into the upper surface of the retaining ring 110. An inner surface of the retaining ring 110 defines, in conjunction with the lower surface of the flexible membrane 120, a substrate receiving recess. The retaining ring 110 prevents the substrate from escaping the substrate receiving recess. The retaining ring 110 can include a lower portion 112 and an upper portion 114 that is more rigid than the lower portion 112. The lower portion 112 can be a plastic, such as polyphenylene sulfide (PPS) or polyetheretherketone (PEEK). The lower portion 112 can be substantially pure plastic (consist of plastic), e.g., no non-plastic fillers. The upper portion 114 can be a metal, e.g., stainless steel.

A pressure controller can be fluidly connected to the chamber 104 though a passage in the housing 102 and/or base assembly 130 to control the pressure in the chamber 104 and thus the position of and/or downward pressure on the base assembly 130, and thus the retaining ring 110. Similarly, pressure controllers can be fluidly connected to the chambers 122 though passages 108 in the housing 102 and/or base assembly 130 to control the pressures in the chambers 122 and thus the downward pressures of the flexible membrane 120 on the substrate.

Alternatively, the base assembly 120 and the housing 102 could be combined into a single part (with no chamber 122 and the base assembly 120 not vertically movable relative to the housing 102). In some of these implementations, the drive shaft 120 can be raised and lowered to control the pressure of the retaining ring 110 on the polishing pad. In another alternative, the retaining ring 110 can be movable relative to the base assembly 120 and the carrier head 100 can include an internal chamber which can be pressurized to control a downward pressure on the retaining ring, e.g., as described in U.S. Pat. No. 7,699,688, which is incorporated by reference.

The flexible membrane 120 can be a silicone membrane. The flexible membrane can include multiple flaps 124 that divide the volume between the flexible membrane 120 and the base assembly 104 into individually controllable chambers. The ends of the flaps 124 can be attached to the base assembly 130, e.g., clamped to the base assembly 130.

An annular external ring 126 can be inset into a recess in the outer surface of the outer perimeter portion of the flexible membrane 120. An annular internal ring 128 can abut the inner surface of the of the outer perimeter portion of the flexible membrane 120. The external ring 126 and internal ring 128 increase the rigidity of the perimeter portion of the flexible membrane 120. This can permit pressure in an upper chamber of the multiple chambers to be transmitted through the perimeter portion to the substrate.

The end of each flap can be clamped between clamps 132. The various clamps can be a substantially pure plastic, e.g., polyetheretherketone (PEEK), or polyphenylene sulfide (PPS), a composite plastic, e.g., a glass filled PPS or glass-filled PEEK, or a metal, e.g., stainless steel or aluminum.

A gimbal mechanism 136 (which can be considered part of the base assembly 130) permits the base assembly 130 to slide vertically relative to the housing 102 while restricting lateral motion of the base assembly 130. A cover 138, e.g., formed of semi-crystalline thermoplastic polyester based on polyethyleneterephthalate (PET-P), e.g., Ertalyte™, can be draped over the outer side of the base assembly 130 to prevent contamination from slurry from reaching the interior of the carrier head 100.

Together, the gimbal mechanism 136, various clamps 132, and cover 152, can be considered to provide the base assembly 130.

Figure 4:
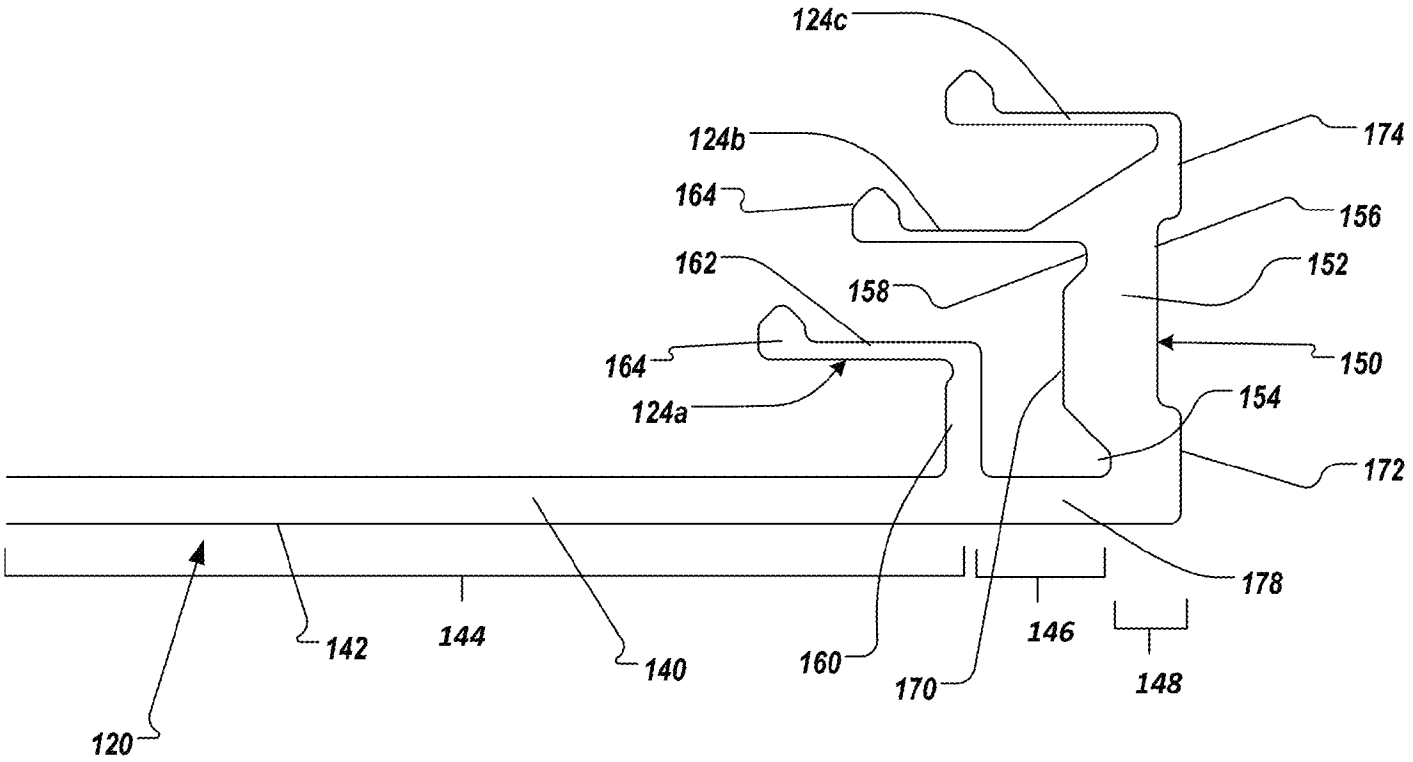
FIG. 4 is a schematic cross-sectional view of a membrane from the carrier head of FIG. 2.

Referring to FIGS. 3 and 4, in some implementations, e.g., for a 150 mm diameter substrate, the membrane includes exactly three flaps, including an inner flap 124*a*, a middle flap 124*b*, and an outer flap (not shown in FIG. 3), which define three chambers 122*a*, 122*b* and 122*c*. The first chamber 122*a* is a generally circular chamber located within the innermost flap 124*b*. The second chamber 122*b* is an annular chamber surrounding the first chamber 122*a*, and is defined by the volume between the innermost flap 124*a* and the middle flap 124*b*. The third chamber 122*c* can be positioned above the second chamber 122*b*, and is defined by the volume between the middle flap 124*b* and the outer flap 124*c*.

As shown in FIG. 4, the flexible membrane 120 can have a generally flat main portion 140 and an outer annular portion 150. The lower surface of the main portion 510 provides a substrate-mounting surface 142. The lower edge of the outer portion 150 is joined to the outer edge of the main portion 140.

The inner annular flap 124*a* is joined to the upper surface of the main portion 140 of the flexible membrane 120. Thus, the downward pressure on an inner circular portion 144 of the substrate mounting surface 142, located within the region where the inner annular flap 124*a* is connected to the main portion 140, is controlled primarily by the pressure in the first chamber 124*a* (see FIG. 2). On the other hand, the downward pressure on an outer annular portion 146 of the substrate mounting surface 142, located between where the inner annular flap 124*a* is connected to the main portion 140 and the outer annular portion 150 is controlled primarily by the pressure in the second chamber 124*b* (see FIG. 2).

The inner flap 124*a* can be joined to the inner surface of the main portion 140 at a radial position between 75% and 95%, e.g., between 80% and 85%, of the radius of the substrate mounting surface 142. For polishing of a 150 mm diameter substrate, the substrate mounting surface 142 (and the main portion 140) can have a radius of about 75 mm. The inner flap 124*a* can be connected to the main portion 140 at about 10 mm from the edge of the substrate mounting surface. Thus, the inner circular portion 144 can have a radius of about 65 mm, and the outer annular portion 146 can have a width of about 10 mm.

The inner annular flap 124*a* can include a vertical portion 160 extending upwardly from the main portion 140, and a horizontal portion 162 extending horizontally from the upper edge of the vertical portion 160. The horizontal portion 120 can extend inwardly (toward the center of the carrier head) from the vertical portion 160. The end of the horizontal portion 162 can have a thick rim portion 164 which can be configured to fluidly separate the chambers 122*a*, 122*b* when secured to a base assembly 104. For example, assuming the horizontal portion 162 extends inwardly from the vertical portion 160, the thick rim portion 164 can be located at the inner edge of the horizontal portion 162.

The outer portion 150 of the flexible membrane 120 includes a body 152 that extends upwardly from the outer edge of the main portion 140. The body 152 can be thicker than the main portion 140 of the flexible membrane 120. A recess 154 can be formed in the inner surface of the body 152 at the juncture between the body 152 and the main portion 140. This recess 154 can permit the body 152 to pivot more freely relative to the main body 140.

The outer annular portion 150 can have an annular recess 156 along its outer wall. The annular external ring 126 (see FIG. 3) can be inset into the recess 156. The portion 172 of the outer surface of the body between the recess 156 and the lower edge can be laterally aligned with the portion 174 of the outer surface of the body between the recess 156 and the upper edge The middle annular flap 124*b* can extend horizontally inward from the annular outer portion 150, e.g., from the inner surface of the body 152. The middle flap 124*b* can be connected to the body 152 at the widest point of the body 152. The inner edge of the middle flap 124*b* can have a thick rim portion 164 which can be configured to fluidly separate the chambers 122*b*, 122*c* when secured to a base assembly 104.

A section 178 of the main portion 140 of the membrane 120 between the flap 124*a* and the outer portion 150 of the membrane 120 can optionally be thinner than the section of the main portion 140 located radially inward of the flap 124*a*.

In some implementations, a recess 158 is formed in the inner surface of the body 152 at the juncture between the middle flap 124*b* and the body 152.

The outer flap 124*c* can extend inwardly from the upper edge of the outer annular portion 150. The inner edge of the outer flap 124*c* can have a thick rim portion 164 which can be configured to fluidly separate the third chamber 122*c* from the environment outside the carrier head when secured to a base assembly 104.

When the third chamber 122*c* (see FIG. 2) is pressurized, pressure on the surface 170 is transmitted through the body 152 to apply a pressure on an edge portion 148 substrate mounting surface 142.

Referring to FIGS. 3 and 4, the internal ring 128 can include a generally vertical cylindrical section 180 that when positioned in the carrier head abuts the inside surface 170 of the outer portion 150 of the membrane 120. The internal ring 128 can include an outwardly extending rounded lip 182 positioned at the top of the vertical section 180 that can fit into the recess 158. The internal ring 128 can include an outwardly extending flange 184 that projects downwardly at an angle from the bottom of the vertical section 180 that can fit into the recess 154.

The internal ring 128 further includes an inwardly extending flange 186 that projects downwardly at an angle from the bottom of the vertical section 180. The flange 186 projects inwardly to almost contact the outer surface of the vertical portion 160 of the flap 124*a*. For example, there can a gap of between about 5 and 15 mils between the flange 186 and the vertical section 160. The flange also projects toward, without contacting, the upper surface of the section 178 of the main portion 140 of the membrane 120 between the flap 124*a* and the outer portion 150 of the membrane 120. The outwardly projecting flange 184 can project beyond the inwardly projecting flange 186, although this is not required. A total distance between the bottom of the outwardly projecting flange 186 and the upper surface of the main portion of the membrane 120 can be between about 30 and 50 mils.

Figure 1C:
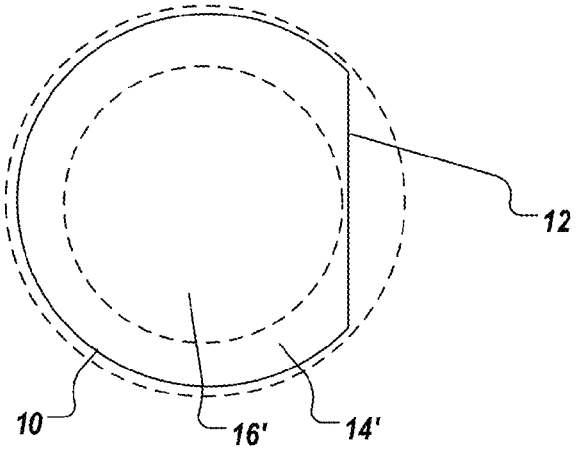
FIG. 1C is a schematic top view showing regions where vacuum and pressure are applied to a flatted wafer.

Without being limited to any particular theory, when pressure is applied in the third chamber 122*c* and vacuum is applied to the first chamber 122*a* and the second chamber 122*b*, the inwardly projecting flange 186 limits upward motion of the section 178 of the membrane 120. This can assist the bottom portion of the section 178 to remain in contact with the top surface of the substrate 10 in a region that extends inwardly past the flat 12. Thus, referring to FIGS. 1C and 3, when pressure is applied in the third chamber 122*c* and vacuum is applied to the first chamber 122*a* and the second chamber 122*b*, the membrane 120 remains in contact with the substrate over a region 14'. Thus, the region 16' where vacuum is applied can remain sealed, thus improving reliability of the chucking operation.

The present invention has been described in terms of a number of embodiments. The invention, however, is not limited to the embodiments depicted and described. For example, the internal ring could be used for a carrier head for wafers of 200 mm diameter or greater, and for membranes that provide more than three chambers. Rather, the scope of the invention is defined by the appended claims.

What is claimed is:

1. A reinforcement ring for placement in a carrier head to abut an inner surface of a perimeter portion of a flexible membrane, comprising:

a substantially vertical cylindrical portion;

a first flange projecting inwardly from a bottom of the cylindrical portion, the first flange projecting downwardly at a non-zero angle from vertical such that a bottom of the first flange at a tip distal from the vertical cylindrical portion is lower than a bottom of the first flange at a proximal end where the first flange connects to the vertical cylindrical portion; and a second flange projecting outwardly from a bottom of the cylindrical portion.

2. The reinforcement ring of claim 1, wherein the second flange extends downwardly at a non-zero angle from vertical.

3. The reinforcement ring of claim 1, wherein the second flange extends lower than the first flange.

4. A reinforcement ring for placement in a carrier head to abut an inner surface of a perimeter portion of a flexible membrane, comprising a substantially vertical cylindrical portion;

a first flange projecting inwardly from a bottom of the cylindrical portion, the first flange projecting downwardly at a non-zero angle from vertical;

a second flange projecting outwardly from a bottom of the cylindrical portion; and an outwardly extending lip positioned at a top of the cylindrical portion.

5. The reinforcing ring of claim 1, wherein the angle is between 30° and 60°.

6. A carrier head for a chemical mechanical polishing system, comprising:

a base assembly;

a retaining ring secured to the base assembly;

a flexible membrane secured to the base assembly, the flexible membrane including a main portion with a lower surface to provide a substrate-mounting surface, an annular outer portion extending upwardly from an outer edge of the main portion, the annular outer portion having a lower edge connected to the main portion and an upper edge, and a plurality of annular flaps connected to the base assembly to divide a volume between the main portion and the base assembly into a plurality of chambers, the plurality of annular flaps including a first annular flap joined to an inner surface of the main portion; and a reinforcement ring including a substantially vertical cylindrical portion abutting an inner surface of the annular outer portion, and a first flange projecting inwardly from a bottom of the cylindrical portion without contacting the first annular flap, the first flange projecting downwardly at a non-zero angle from vertical.

7. The carrier head of claim 6, wherein the plurality of annular flaps include a second annular flap joined to the annular outer portion at a position between a lower edge of the outer annular portion and an upper edge of the outer annular portion, the second annular flap extending inwardly from the outer annular portion, and a third annular flap joined to the upper edge of the annular outer portion, the third annular flap extending inwardly from the outer annular portion.

8. The carrier head of claim 7, wherein the membrane and reinforcement ring are configured such that when pressure is applied to both a first chamber between the first flap and the second flap and to a second chamber between the second flap and the third flap, the first flange does not contact an inner surface of a section of the main portion between the first flap and the annular outer portion.

9. The carrier head of claim 8, wherein the membrane and reinforcement ring are configured such that when vacuum is applied to the first chamber and pressure is applied to the second chamber, the first flange contacts the inner surface of the section of the main portion between the first flap and the annular outer portion.

10. The carrier head of claim 6, wherein the membrane includes a recess on an inner surface of the annular outer portion and the reinforcement ring includes a second flange projecting outwardly from the bottom of the cylindrical portion into the recess.

11. The carrier head of claim 10, wherein the second flange extends downwardly at a non-zero angle from vertical.

12. The carrier head of claim 11, wherein the second flange extends lower than the first flange.

13. The carrier head of claim 6, wherein the membrane includes a recess on an inner surface of the annular outer portion and the reinforcement ring includes an outwardly extending lip positioned at a top of the cylindrical portion and projecting into the recess.

14. The carrier head of claim 6, wherein the angle is between 30° and 60°.

15. The carrier head of claim 6, wherein a section of the main portion between the first flap and the annular outer portion is thinner than a section of the main portion radially inward of the first flap.

16. The carrier head of claim 6, wherein the substrate-mounting surface has a diameter of about 150 mm.

17. The carrier head of claim 16, wherein the first annular flap is joined to the main portion about 10 mm from the outer edge of the main portion.

18. The carrier head of claim 6, wherein the flexible membrane includes an annular recess in an outer surface of the annular outer portion and a second reinforcement ring positioned in the recess.

19. The reinforcement ring of claim 1, wherein a bottom surface of the first flange between the tip and the proximal end provides a smooth surface sloped at an angle from horizontal.

* * * * *